US009163902B1

(12) United States Patent
Cheng et al.

(10) Patent No.: US 9,163,902 B1
(45) Date of Patent: Oct. 20, 2015

(54) SIGHT MODULE

(71) Applicants: Carson Cheng, City of Industry, CA (US); Changan Tian, City of Industry, CA (US)

(72) Inventors: Carson Cheng, City of Industry, CA (US); Changan Tian, City of Industry, CA (US)

(73) Assignee: NcSTAR.Inc., City of Industry, CA (US)

( * ) Notice: Subject to any disclaimer, the term of this patent is extended or adjusted under 35 U.S.C. 154(b) by 0 days.

(21) Appl. No.: 14/446,334

(22) Filed: Jul. 30, 2014

(51) Int. Cl.
*F41G 1/38* (2006.01)

(52) U.S. Cl.
CPC ..... *F41G 1/38* (2013.01)

(58) Field of Classification Search
CPC ..... F41G 1/345; F41G 1/38; F41G 11/003
USPC ..... 42/122, 113, 111, 114, 115, 90, 42/124–126, 128–129, 140–141
See application file for complete search history.

(56) References Cited

U.S. PATENT DOCUMENTS 5,383,278 A * 1/1995 Kay ..... 33/265
5,448,402 A * 9/1995 Lorenzana ..... 359/550
8,327,573 B1 * 12/2012 Cheng et al. ..... 42/115
8,393,109 B2 * 3/2013 Gilmore ..... 42/113
8,599,481 B2 * 12/2013 Thomas et al. ..... 359/418
2011/0167708 A1 * 7/2011 Cheng ..... 42/114
2011/0232152 A1 * 9/2011 Thomas et al. ..... 42/125
2014/0118821 A1 * 5/2014 Thomas et al. ..... 359/421
2014/0153119 A1 * 6/2014 Schmitt et al. ..... 359/818
2014/0237884 A1 * 8/2014 Koesler et al. ..... 42/119
2014/0259853 A1 * 9/2014 Crispin ..... 42/124
2014/0305022 A1 * 10/2014 Chung ..... 42/113

* cited by examiner

*Primary Examiner* — Michael David

(74) *Attorney, Agent, or Firm* — Raymond Y. Chan; David and Raymond Patent Firm

(57) ABSTRACT

A sight module includes a mounting base for detachably mounting on a firearm, a sight unit including a sight housing upwardly extended from the mounting base, a reflex sight including a light unit supported by the sight housing for generating a sight reticle, and a foldable lens movably coupled at the sight housing and being actuated to move between a first position and a second position. In the first position, the foldable lens is folded at the sight housing. In the second position, the foldable lens is moved to outwardly extend from the sight housing, such that the sight reticle generated by the reflex sight is projected on the foldable lens in the second position.

16 Claims, 17 Drawing Sheets

SIGHT MODULE

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

1. Field of Invention

The present invention relates to a sight device, and more particular to a sight module, which integrates a sight device with a reflex sight for facilitating an operator to aim a target in different environments.

2. Description of Related Arts

Conventional firearm, such as a gun or a rifle, usually needs different firearm accessories for assisting the operator to accurately locate the target and perform the shooting. Sighting device, such as a scope, reflex sight, telescope, camera lens module, or binoculars, generally comprises a tubular lens housing and a lens supported in the lens housing. For example, scopes are sighting device and are commonly used in conjunction firearms, such as rifles, to give an accurate aiming point and to aid the operator in properly aligning a barrel of the firearm with a desired target. Accordingly, two lenses are provided at two ends of the lens housing to define an objective end and a sight (ocular) end. The scope further comprises a scope luminous element which is powered by a battery and is operatively provided in the lens housing for illumining a scope reticle thereof.

Accordingly, magnified or powered scopes are used for mid to long range sniping to aim and identify targets at further distances. The magnified scope generally comprises windage and elevation knobs to change an apparent reticle position of the scope. In particular, the windage knob is used to adjust the scope in the horizontal axis and the elevation knob is used to adjust the scope in the vertical axis. The calibration of the apparent reticle position is incorporate with the bore of the barrel of the firearm according to the hand-eye position of the user in order to allow the user to precisely aim and shoot the target.

Reflex sight device is another type of scope device which is better suited for quick target acquisition and is easier for tracking moving targets at closer ranges comparing with the magnified scope. Reflex sight generally comprises a lens with a luminous to create an optical collimator so as to produce a virtual image of the reticle. A control switch is provided for controlling the reticle illumination level and dot brightness level of the reflex sight.

The magnified scope and reflex sight are perfect companion for the user to aim and identify targets at different distances. The user can switch between these two scope devices especially for a moving target. However, the magnified scope and reflex sight must be individually mounted at different locations of the firearm. In other words, the two individual scope devices will also take up limited mounting space of the firearm, such that other firearm accessories, such as laser sight, navigation lights, flashlight, or a camera, will not be able to attach to the firearm. In addition, since each scope device employs its own power source for reticle illumination. As a result, the overall weight of the scope devices will be substantially increased to apply additional weight on the firearm. More importantly, the magnified scope and reflex sight have their sizes, such that when the magnified scope and reflex sight are individually mounted on the firearm, the overall size of the firearm will bulky.

SUMMARY OF THE PRESENT INVENTION

The invention is advantageous in that it provides a sight module, which integrates a sight device with a reflex sight for facilitating an operator to aim a target in different environments.

Another advantage of the invention is to provide a sight module, wherein a foldable lens can be selectively moved between a first position to minimize the overall side of the sight module and a second position that the sight reticle generated by the reflex sight is projected on the foldable lens.

Another advantage of the invention is to provide a sight module, wherein the foldable lens can be moved between the first and second positions via one of the rotatable joint, flipping joint and sliding joint.

Another advantage of the invention is to provide a sight module, wherein the reflex sight of the present invention is a lens-less reflex sight that the sight reticle is projected on the foldable lens only when the foldable lens is moved in the second position.

Another advantage of the invention is to provide a sight module, wherein when the foldable lens is moved in the first position, the reflex sight will provide a low profile configuration comparing with the existing lens-equipped reflex sight.

Another advantage of the invention is to provide a sight module, wherein the foldable lens not only forms a projection lens for the sight reticle being projected thereon in the second position but also serves as a protection lens for protecting the objective lens of the sight unit in the first position. Therefore, the foldable lens provides multiple functions for the sight module.

Another advantage of the invention is to provide a sight module, wherein the guiding means is provided for guiding the foldable lens between the first and second positions. The guiding means can be the guiding slot and/or the guiding arm to guide the rotatable movement, flipping movement, or sliding movement of the foldable lens.

Another advantage of the invention is to provide a sight module, which does not require to alter the original structural design of the sight unit, so as to minimize the manufacturing cost of the foldable lens incorporating with the sight unit.

Another advantage of the invention is to provide a sight module, wherein no expensive or complicated structure is required to employ in the present invention in order to achieve the above mentioned objects. Therefore, the present invention successfully provides an economic and efficient solution for providing a dual sight configuration for the firearm with compact and ergonomic design.

Additional advantages and features of the invention will become apparent from the description which follows, and may be realized by means of the instrumentalities and combinations particular point out in the appended claims.

According to the present invention, the foregoing and other objects and advantages are attained by a sight module for a firearm, which comprises a mounting base for detachably mounting on the firearm, and a sight unit which comprises a sight housing upwardly extended from the mounting base to define a first sight axis parallel to a barrel axis of the firearm.

The sight module further comprises a foldable lens movably coupled at the sight housing and being actuated to move between a first position and a second position, wherein in the first position, the foldable lens is folded at the sight housing, and in the second position, the foldable lens is moved to outwardly extend from the sight housing, such that the sight reticle generated by the reflex sight is projected on the foldable lens in the second position.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
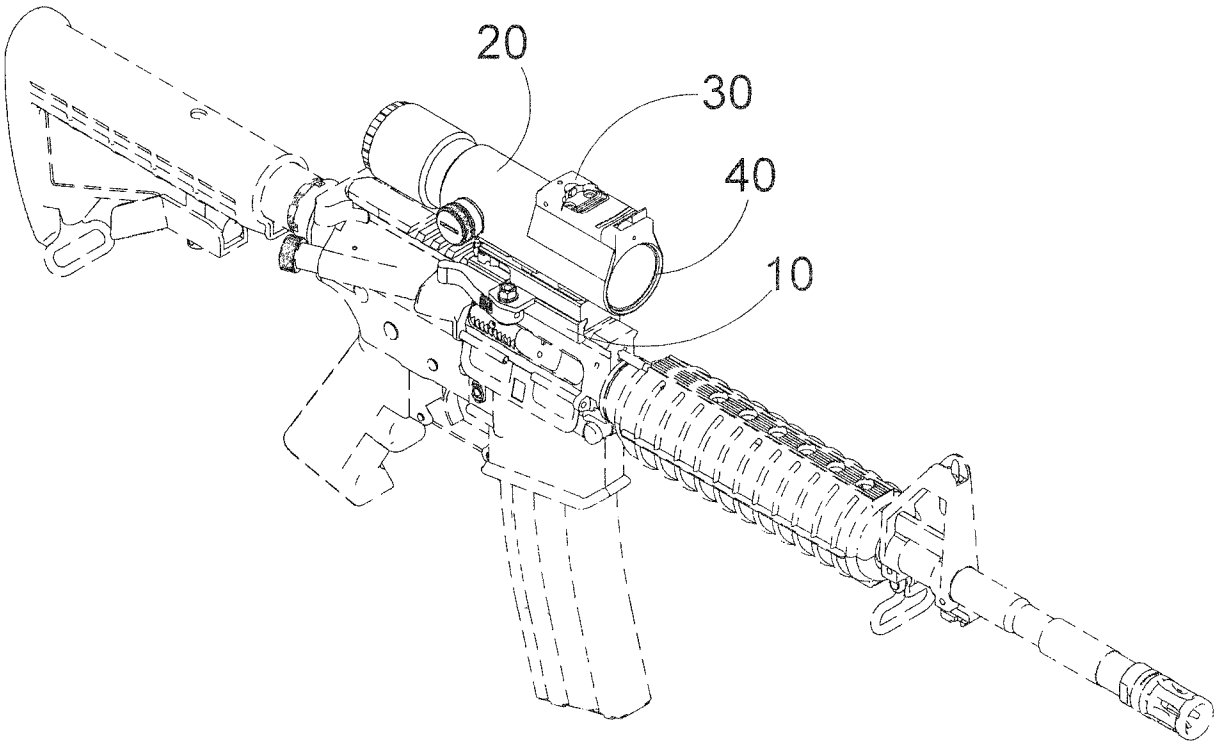
FIG. 1 is a perspective view of a sight module mounted on a firearm according to a first preferred embodiment of the present invention.
Figure 2:
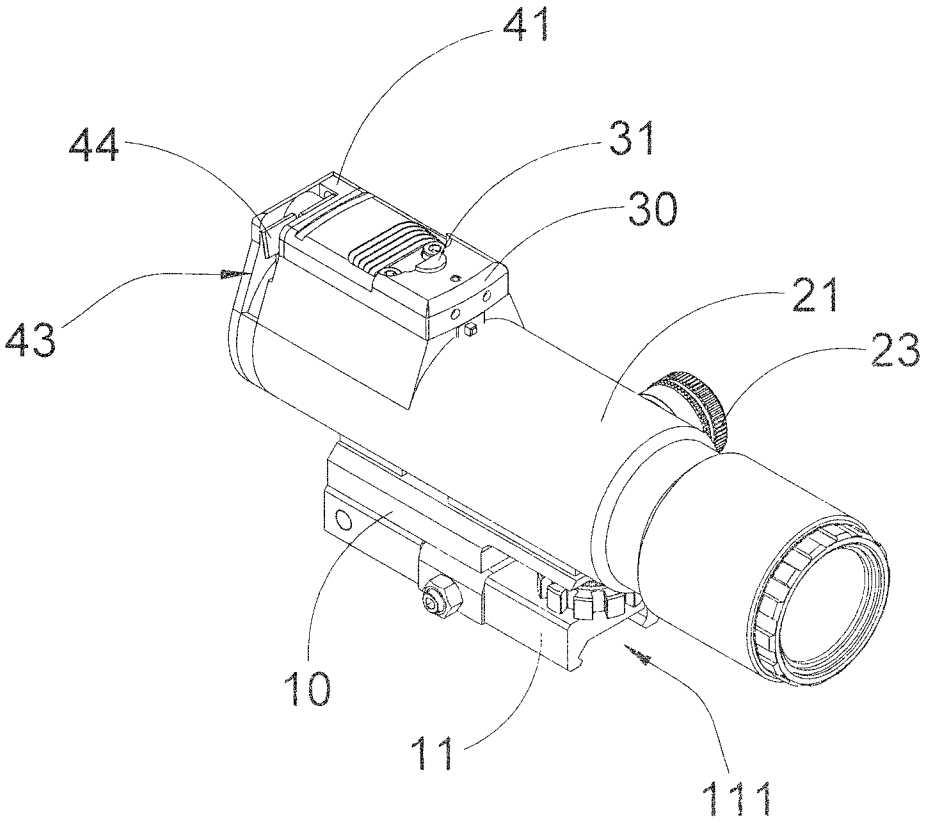
FIG. 2 is a perspective view of the sight module according to the above first preferred embodiment of the present invention.
Figure 3:
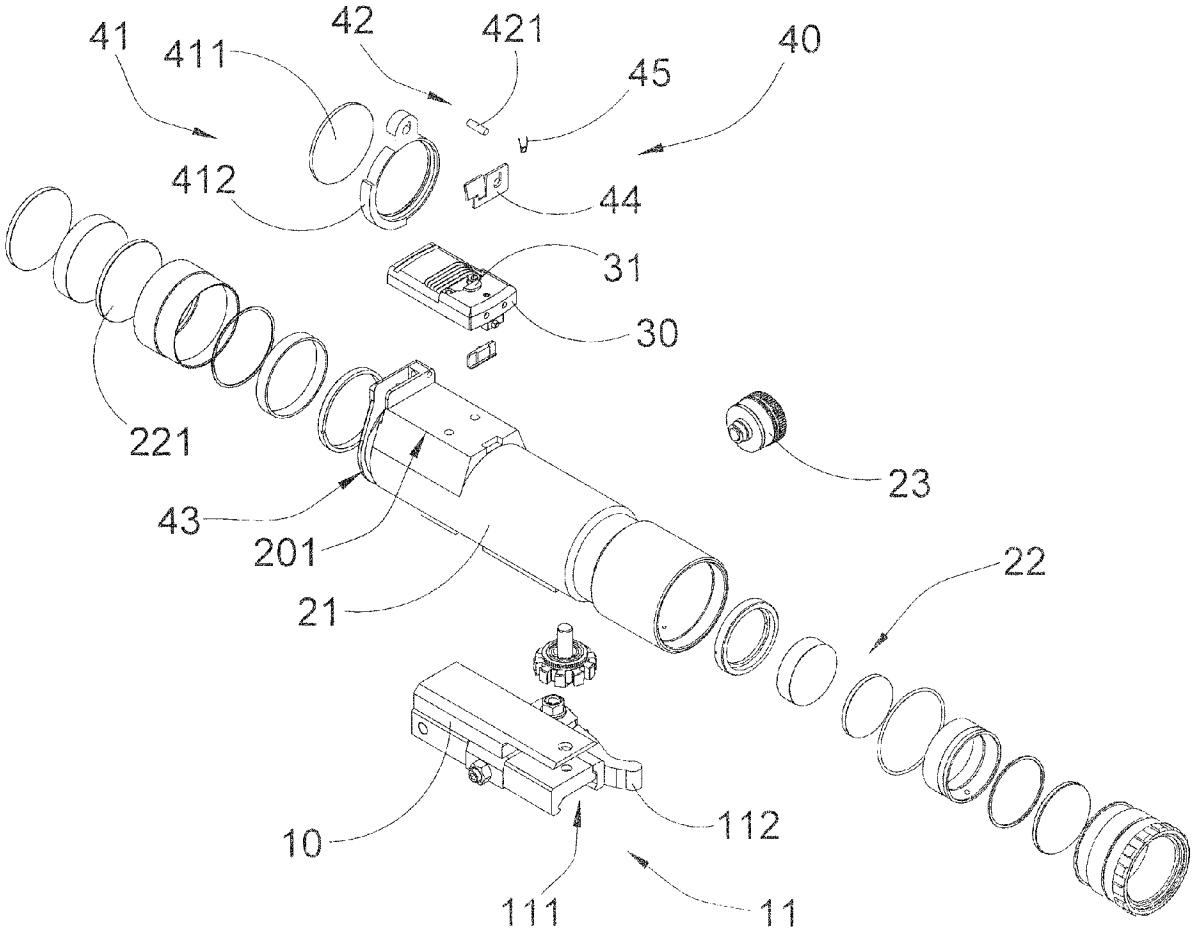
FIG. 3 is an exploded perspective view of the sight module according to the above first preferred embodiment of the present invention.

Referring to FIG. 1 of the drawings, a sight module according to a first preferred embodiment of the present invention is illustrated, wherein the sight module is adapted for detachably mounting on a firearm. As shown in FIGS. 2 and 3, the sight module comprises a mounting base 10, a sight unit 20, a reflex sight 30, and a lens arrangement 40.

The mounting base 10 comprises an attachment arrangement 11 provided at a bottom side of the mounting base 10 for detachably attaching onto the firearm. The mounting arrangement 11 can be configured to have a "Weaver" mounting structure, a "Picatinny" mounting structure, or "KeyMod" mounting structure to detachably couple at the firearm. Preferably, the mounting arrangement 11 is a quick releasing mount having a mounting slot 111 at the bottom side of the mounting base 10 and comprising a locking lever 112 to rapidly lock and unlock the mounting arrangement 11 at the firearm. Preferably, the mounting base 10 has a low profile design to be mounted on the firearm.

The sight unit 20 comprises a sight housing 21 upwardly extended from the mounting base 10 to define a sight axis parallel to a barrel axis of the firearm. According to the preferred embodiment, the sight unit 20 is a magnified scope, wherein the sight housing 21 is upwardly extended from a top side of the mounting base 10. The sight unit 20 further comprises a lens assembly 22 provided in the sight housing 21 that provides magnification zoom for aiming and identifying target at further distances, and a reticle adjustment 23 formed at a surrounding wall of the sight housing 21 for selectively adjusting a reticle position of the sight unit 20. In particular, the lens assembly 22 comprises an objective lens 221 supported at a front opening of the sight housing 21.

The reflex sight 30 comprises a light unit 31 supported by the sight housing 21 for generating a sight reticle. Preferably, the light unit 31 is supported on a top side of the sight housing 21. Accordingly, the reflex sight 30 is a lens-less reflex sight that no lens is included in the reflex sight 30.

Figure 4:
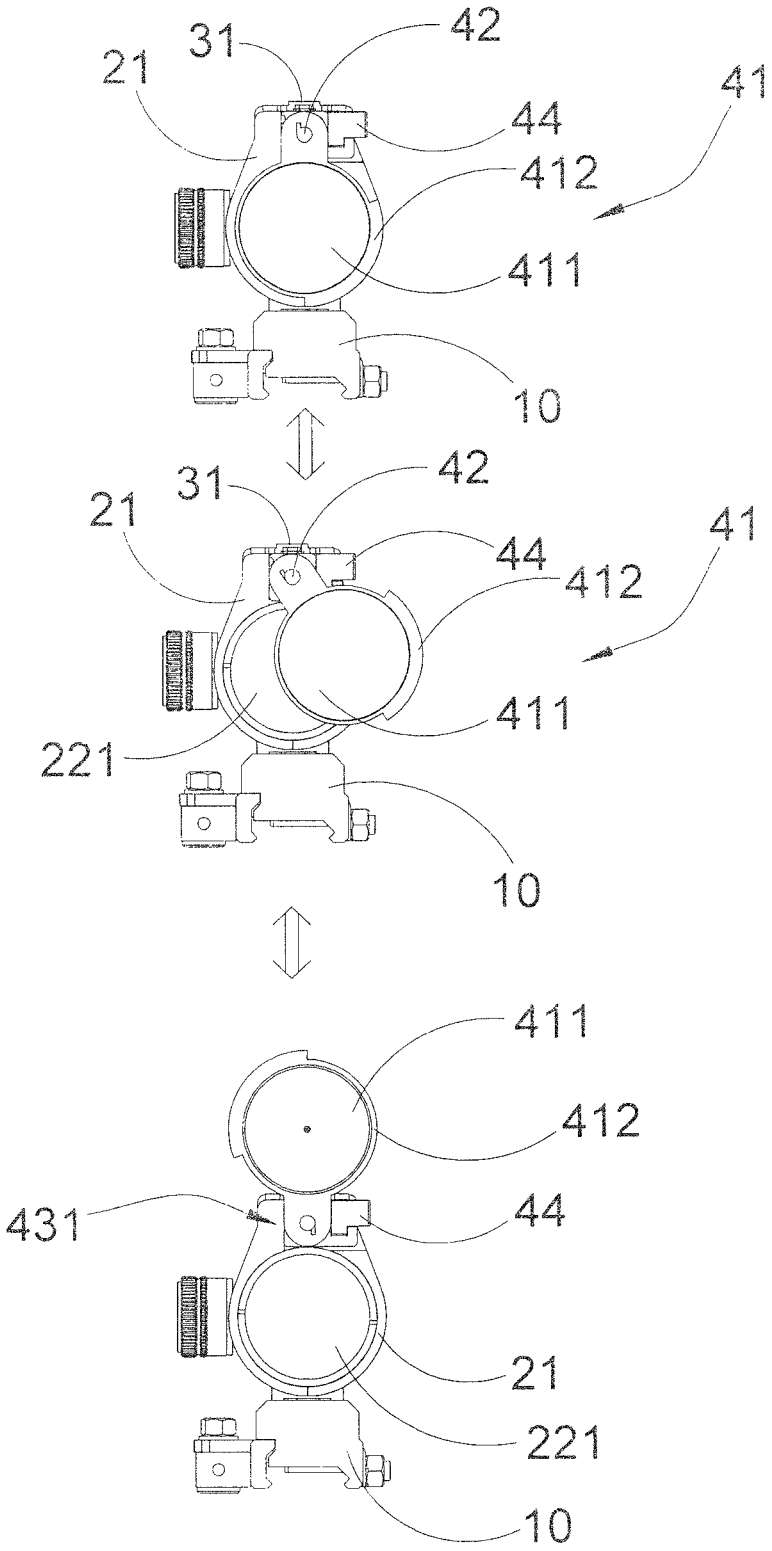
FIG. 4 is a front view of the sight module according to the above first preferred embodiment of the present invention, illustrating the rotatable movement of the foldable lens between the first and second positions.
Figure 5:
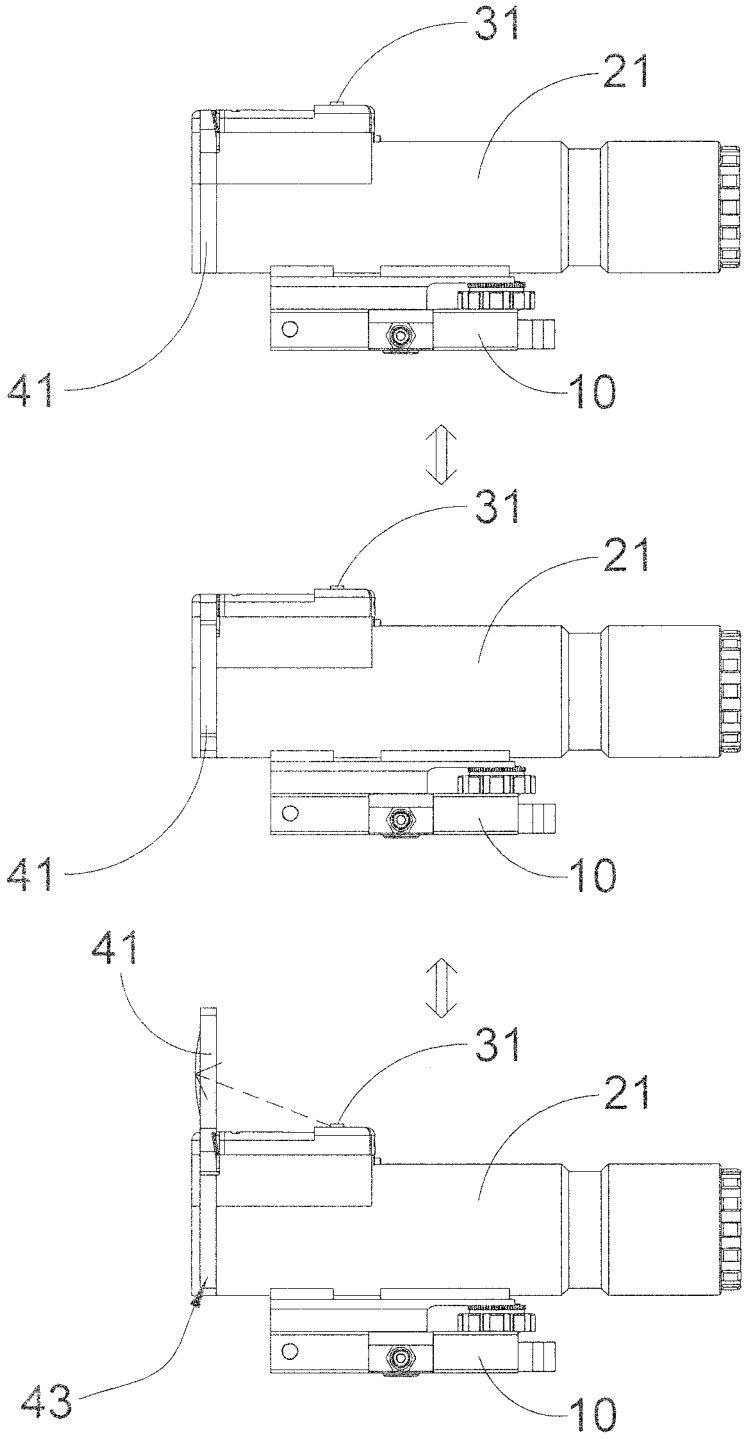
FIG. 5 is a side view of the sight module according to the above first preferred embodiment of the present invention, illustrating the rotatable movement of the foldable lens between the first and second positions.
Figure 6:
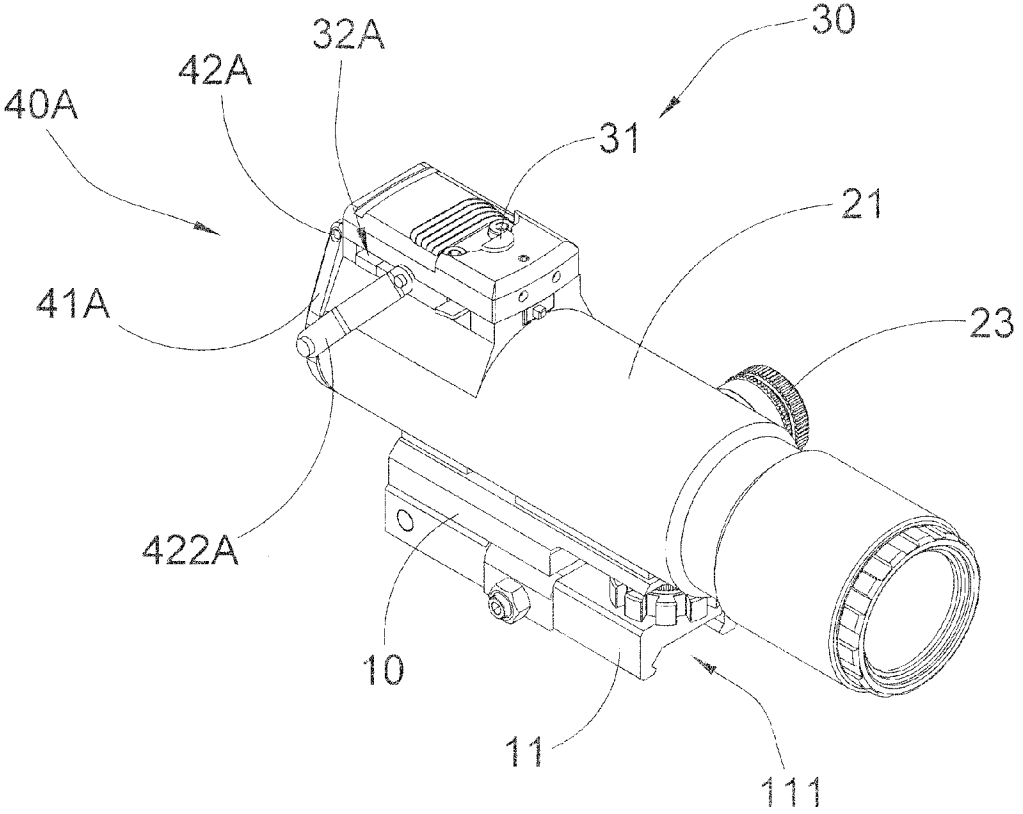
FIG. 6 is a perspective view of the sight module according to a second preferred embodiment of the present invention.
Figure 7:
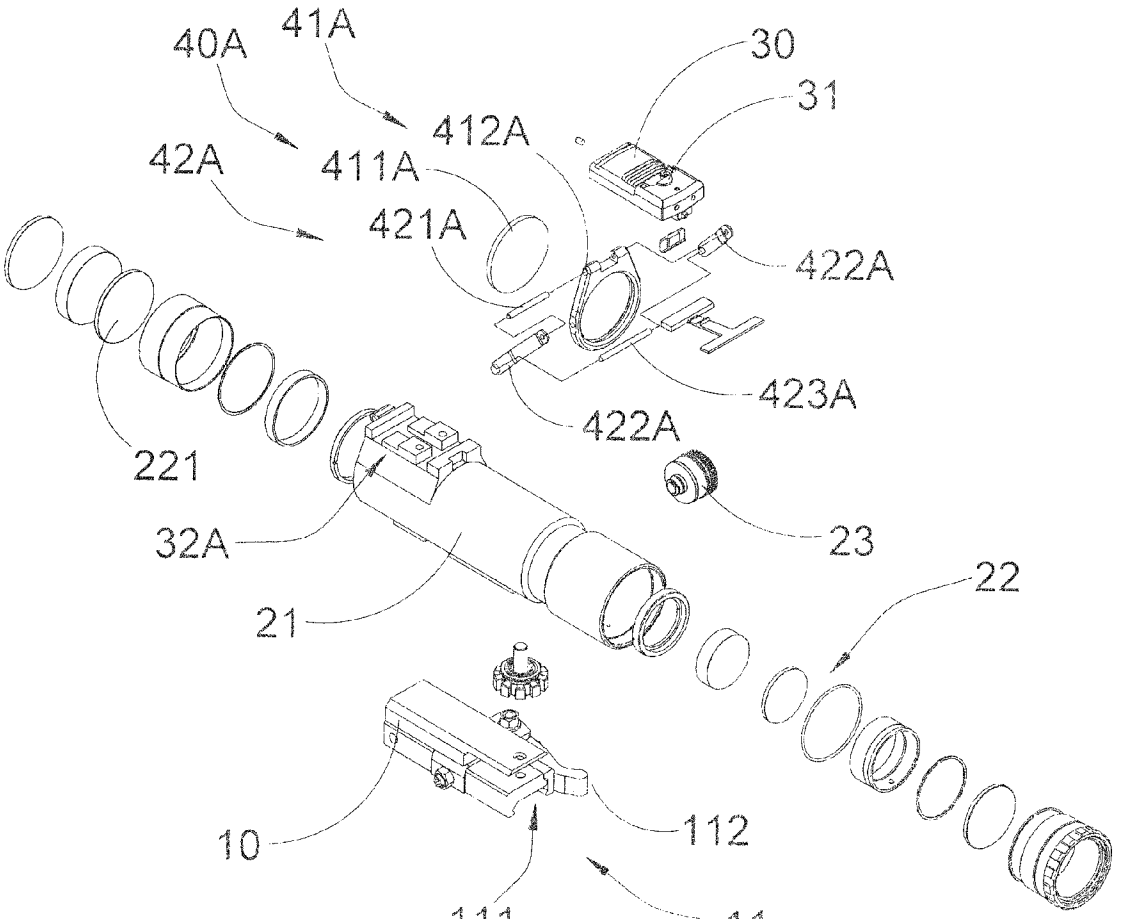
FIG. 7 is an exploded perspective view of the sight module according to the above second preferred embodiment of the present invention.

The lens arrangement 40 comprises a foldable lens 41 movably coupled at the sight housing 21 and being actuated to move between a first position and a second position, as shown in FIGS. 4 and 5. In the first position, the foldable lens 41 is folded at the sight housing 21. In the second position, the foldable lens 41 is moved to outwardly extend from the sight housing 21, such that the sight reticle generated by the reflex sight 30 is projected on the foldable lens 41 in the second position. In other words, the lens-less reflex sight 30 will incorporate with the foldable lens 41 when the foldable lens 41 is moved in the second position only.

The foldable lens 41 comprises a transparent lens body 411 and a lens rim 412 encircling around the lens body 411. The lens body 411 can be made of glass or even plastic that the sight reticle generated by the reflex sight 30 can be projected on the lens body 411.

Accordingly, the sight unit 20 further has an attachment platform 201 formed on the top side of the sight housing 21 to detachably couple with the reflex sight 30, such that the foldable lens 41 is moved upwardly from the sight housing 21 in the second position in order to enable the sight reticle to be projected on the foldable lens 41.

As shown in FIGS. 2 to 5, the lens arrangement 40 further comprises a joint unit 42 coupled between a sidewall of the sight housing 21 and a peripheral edge of the foldable lens 41 to enable the foldable lens 41 to be moved at the front opening of the sight housing 21 in the first position and to be moved outwardly from the front opening of the sight housing 21 so as to enable the sight reticle to be projected on the foldable lens 41 in the second position.

In particular, the joint unit 42, according to the first embodiment, is a rotatable joint which comprises a rotatable axle 421 for rotatably coupling the foldable lens 41 with the sight housing 21, such that the foldable lens 421 is rotatably moved between the first and second positions with respect to the rotatable axle 421. Accordingly, the rotatable axle 421 is coupled between the sidewall of the sight housing 21 and the lens rim 412 of the foldable lens 41, wherein the orientation of the rotatable axle 421 is parallel to the sight axis of the sight unit 20. Therefore, the foldable lens 41 is rotatably folded to overlap and cover at the front opening of the sight housing 21 in the first position. It is worth mentioning that the foldable lens 41 is moved to overlap in front of the objective lens 221 in the first position. The foldable lens 41 is also rotatably and sidewardly folded to upwardly extend from the sight housing 21 in the second position to align with the reflex sight 30. As a result, the foldable lens 41 not only forms a projection lens for the sight reticle being projected thereon in the second position but also serves as a protection lens for protecting the objective lens 221 in the first position.

As shown in FIG. 3, the lens arrangement 40 further has a guiding slot 43 integrally formed at the sidewall of the sight housing 21 at the front opening thereof, wherein the foldable lens 41 is guided to slide at the guiding slot 43 to the first position and is guided to slide out of the guiding slot 43 to the second position. Accordingly, the guiding slot 43 is circumferentially formed at the sidewall of the sight housing 21 at the front portion thereof, wherein a width of the guiding slot 43 is slightly larger than a thickness of the foldable lens 41, such that the foldable lens 41 can be rotatably folded into the guiding slot 43 to coaxially support at the front opening of the sight housing 21. Preferably, the rotatable axle 421 is located out of the guiding slot 43 to ensure the foldable lens 41 to be rotatably slid out of the guiding slot 43 in the second position.

Furthermore, the guiding slot 43 has an arc configuration matching with a curvature of the sight housing 21, wherein the guiding slot 43 has a blocking surface 431 defined at one end of the guiding slot 43 to bias against the peripheral edge of the foldable lens 41 when the foldable lens 41 is moved in the second position. In particular, the foldable lens 41 is rotatably coupled at one end of the guiding slot 43 while the opposed end thereof forms the blocking surface 431 to block the further rotational movement of the foldable lens 41 when the foldable lens 41 is rotated in the second position.

As shown in FIGS. 3 and 4, the lens arrangement 40 further comprises a locker arm 44 for locking the foldable lens in the first position. Accordingly, the locker arm 44 is normally engaged with the peripheral edge of the foldable lens 41 to lock up the foldable lens in the first position and being moved to disengage with the peripheral edge of said foldable lens to enable the foldable lens to be moved in the second position. In particular, the locker arm 44 is arranged to engage with the lens rim 412 so as to lock up the foldable lens 41 in the first position. The locker arm 44 is movably mounted at the front opening of the sight housing 21, wherein the locker arm 44 has a locking edge extended to and biased against the lens rim 412 so as to retain the foldable lens 41 at the guiding slot 43. Once the locker arm 44 is actuated to move the locking edge to be disengaged with the lens rim 412, the foldable lens 41 is adapted to be rotatably slid out of the guiding slot 43 from the first position to the second position. Preferably, the locker arm 44 is supported at the sight housing 21 via the rotatable axle 421.

The lens arrangement 40 further comprises a resilient element 45 supported by the rotatable axle 421 for applying a pulling against the foldable lens 41 to move the foldable lens 41 from the first position to the second when the locker arm 44 is disengaged with the foldable lens 41. Accordingly, the resilient element 45 is a coil spring having a coil body supported by the rotatable axle 421 and two coil arms extended to bias against the sight housing 21 and the foldable lens 41 respectively. Therefore, once the locker arm 44 is actuated to move the locking edge to be disengaged with the lens rim 412, the resilient element 45 will push the foldable lens 41 out of the guiding slot 43 automatically.

FIGS. 4 and 5 illustrate the rotatable movement of the foldable lens 41. In the first position, the foldable lens 41 is locked by the locker arm 44, such that the foldable lens 41 is retained at the front opening of the sight housing 21 to form the protection lens for protecting the objective lens 221. Once the foldable lens 41 is unlocked by the locker arm 44, the foldable lens 41 will start to rotate about the rotatable axle 421. When the foldable lens 41 is blocked by the blocking surface 431 of the guiding slot 43, the foldable lens 41 is moved in the second position. Accordingly, when the reflex sight 30 is mounted on the top side of the sight housing 21, the foldable lens 41 is rotated to upwardly extend from the sight housing 21. Therefore, the foldable lens 41 forms the projection lens for the sight reticle being projected thereon in the second position. It is worth mentioning that the foldable lens 41 is rotated 180° about the rotatable axle 421 between the first and second positions. It should be appreciated that if the reflex sight 30 is mounted at the side of the sight housing 21, the foldable lens 41 can be rotated 90° or 270° about the rotatable axle 421 to align with the reflex sight 30. In other words, the rotational angle of the foldable lens 41 is determined based upon the location of the reflex sight 30, wherein the blocking surface 431 can be selectively formed with respect to the second position of the foldable lens 41.

It should be appreciated that the sight unit 20 can be a flashlight or a camera module, wherein the foldable lens 41 is rotatably coupled at the sight housing 21 of the flashlight or a camera module. For example, the foldable lens 41 can be a filter lens to incorporate with the flashlight or a camera module while being able for the sight reticle projecting on the foldable lens 41.

It should be also appreciated that a positioning sensor, such as a touch switch, can be incorporated with the foldable lens 41 to automatically switch on the reflex sight 30 when the foldable lens 41 is moved in the second position. For example, the touch switch can be installed at the guiding slot 43 to operatively link to the control switch of the reflex sight 30. Therefore, when the foldable lens 41 is moved at the guiding slot 43 to activate the touch switch, the reflex sight 30 will be automatically switched off. When the foldable lens 41 is moved out of the guiding slot 43 to deactivate the touch switch, the reflex sight 30 will be automatically switched on.

As a result, the operator requires one single action to move the foldable lens 41 from the first position to the second position and to switch on the reflex sight 30 at the same time.

Referring to FIGS. 6 to 9, the sight module of a second embodiment illustrates a first alternative mode of the first embodiment. According to the second embodiment, the sight module has the same configuration of the first embodiment, except the lens arrangement 40A.

Figure 8:
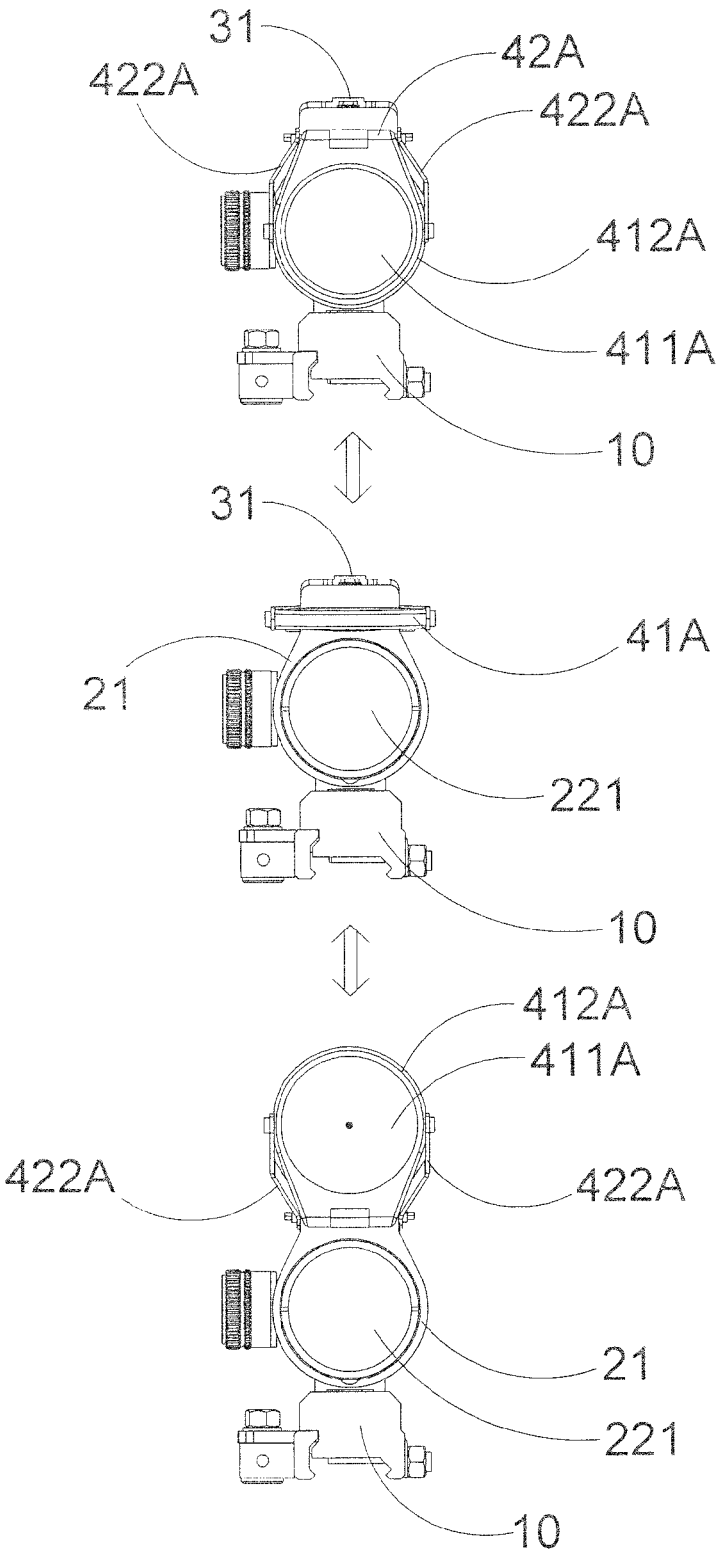
FIG. 8 is a front view of the sight module according to the above second preferred embodiment of the present invention, illustrating the rotatable movement of the foldable lens between the first and second positions.
Figure 9:
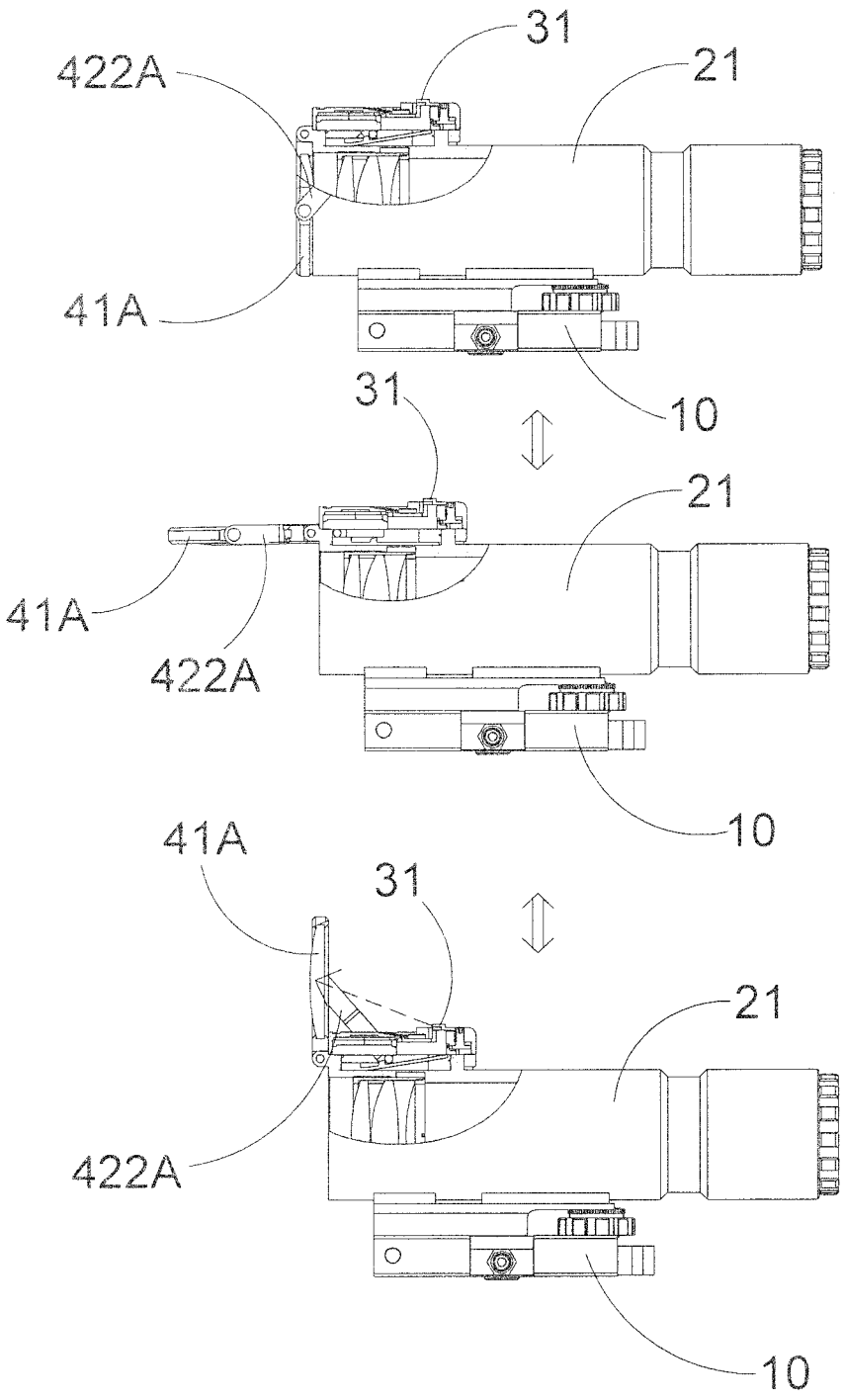
FIG. 9 is a side view of the sight module according to the above second preferred embodiment of the present invention, illustrating the rotatable movement of the foldable lens between the first and second positions.
Figure 10:
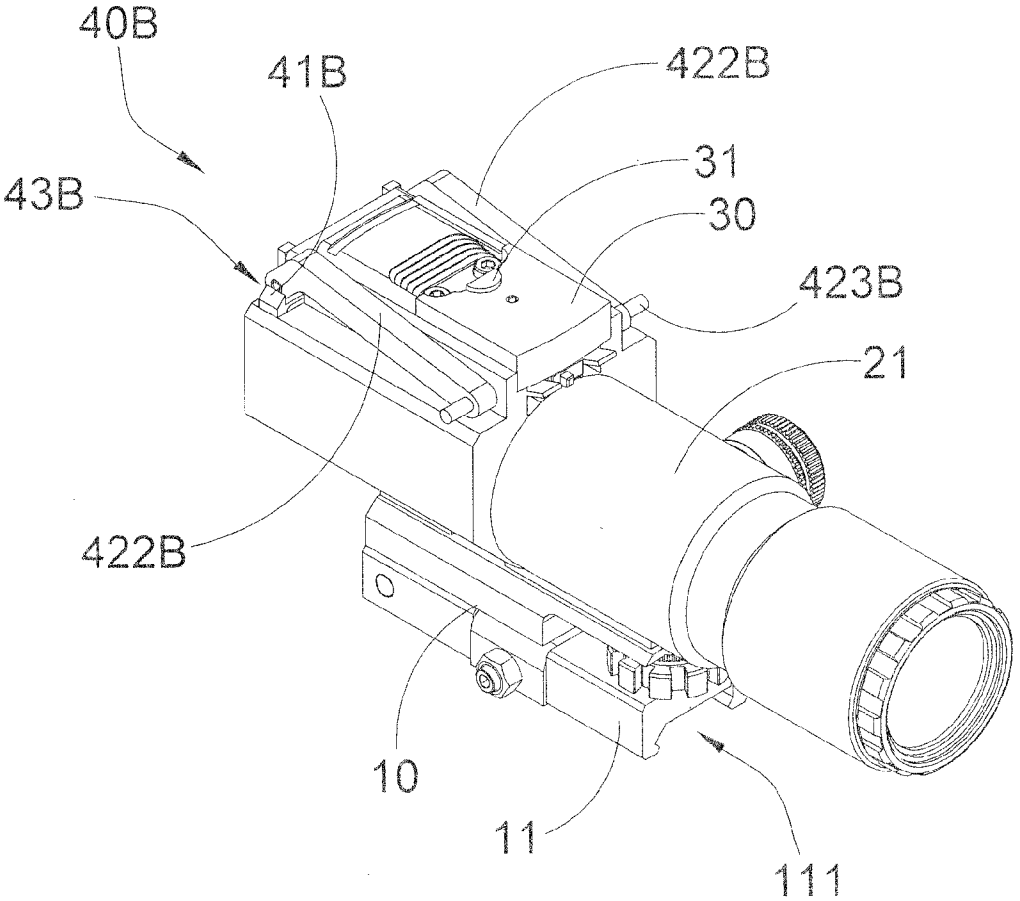
FIG. 10 is a perspective view of the sight module according to a third preferred embodiment of the present invention.
Figure 11:
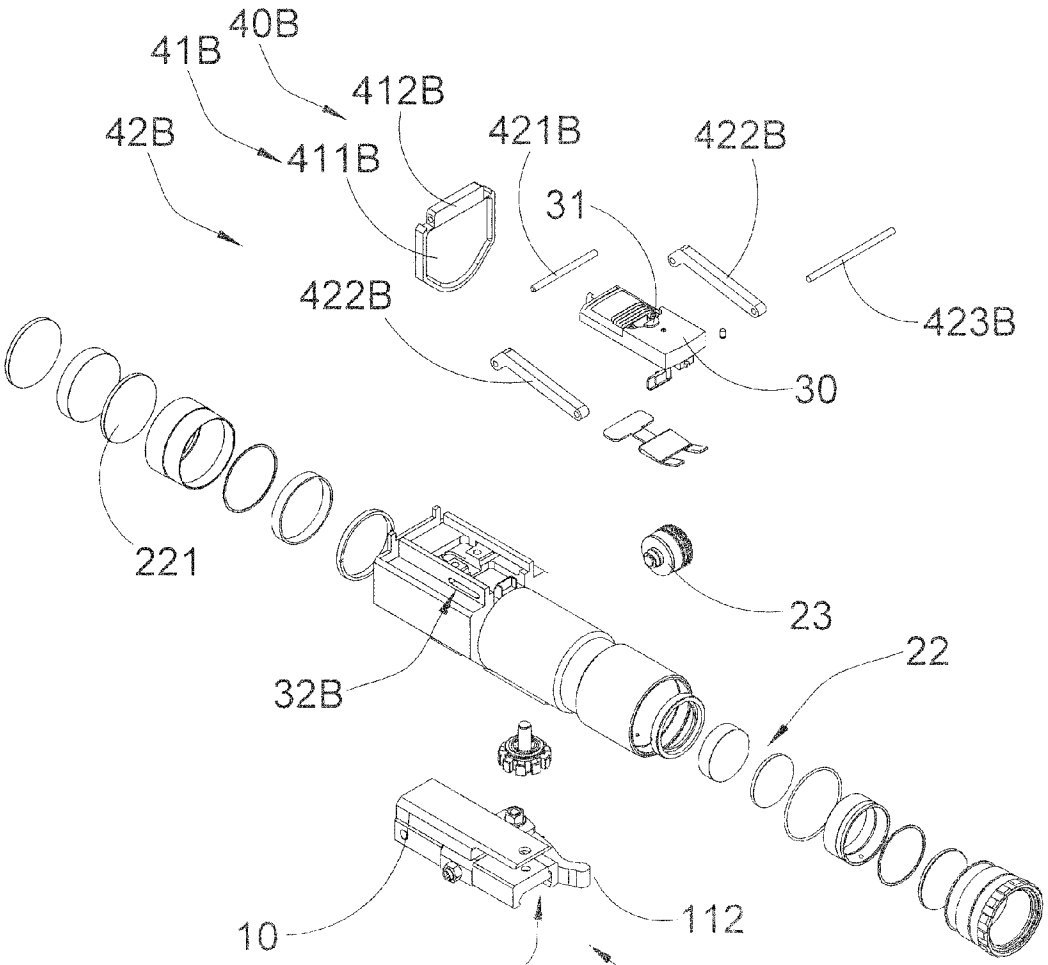
FIG. 11 is an exploded perspective view of the sight module according to the above third preferred embodiment of the present invention.

The lens arrangement 40A comprises a foldable lens 41A movably coupled at the sight housing 21 and being actuated to move between a first position and a second position, as shown in FIGS. 8 and 9. In the first position, the foldable lens 41A is folded at the sight housing 21. In the second position, the foldable lens 41A is moved to outwardly extend from the sight housing 21, such that the sight reticle generated by the reflex sight 30 is projected on the foldable lens 41A in the second position. The foldable lens 41A comprises a transparent lens body 411A and a lens rim 412A encircling around the lens body 411A.

The lens arrangement 40A further comprises a joint unit 42A coupled between a sidewall of the sight housing 21A and a peripheral edge of the foldable lens 41A to enable the foldable lens 41A to be moved at the front opening of the sight housing 21 in the first position and to be moved outwardly from the front opening of the sight housing 21 so as to enable the sight reticle to be projected on the foldable lens 41A in the second position.

In particular, the joint unit 42A, according to the second embodiment, is a flipping joint comprising a rotatable axle 421A for rotatably coupling the foldable lens 41A with the sight housing 21, such that the foldable lens 41A is flipped between the first and second positions with respect to the rotatable axle 421A. Accordingly, the rotatable axle 421A is coupled between the sidewall of the sight housing 21 and the lens rim 412A of the foldable lens 41A, wherein the orientation of the rotatable axle 421A is perpendicular to the sight axis of the sight unit 20. Therefore, the foldable lens 41A is rotatably flipped to overlap and cover at the front opening of the sight housing 21 in the first position. It is worth mentioning that the foldable lens 41A is moved to overlap in front of the objective lens 221 in the first position. The foldable lens 41A is also rotatably and frontwardly flipped to upwardly extend from the sight housing 21 in the second position to align with the reflex sight 30. As a result, the foldable lens 41A not only forms a projection lens for the sight reticle being projected thereon in the second position but also serves as a protection lens for protecting the objective lens 221 in the first position.

As shown in FIGS. 6 to 9, the flipping joint 42A further comprises two guiding arms 422A extended between the reflex sight 30 and the foldable lens 41A, wherein each of the guiding arms 422A has a sliding end slidably coupled at a sidewall of the reflex sight 30 and a pivot end pivotally coupled at the foldable lens 41A, such that when the foldable lens 41A is flipped between the first and second positions, the guiding arms 422A are slid at the sidewalls of the reflex sight 30 to guide a flipping movement of the foldable lens 41A. Accordingly, the pivot ends of the guiding arms 422A are pivotally coupled at two sides of the lens rim 412A respectively to guide the flipping movement of the foldable lens 41A.

For ensuring the flipping movement of the foldable lens 41A, the reflex sight 30 further has two sliding slots 32A longitudinally formed at the two sidewalls to slidably engage with the sliding ends of the guiding arms 422A respectively. Each of the sliding slots 32A has a first blocking end and an opposed second blocking end arranged in such a manner that when the foldable lens 41A is flipped from the first position, the sliding ends of the guiding arms 422A are blocked by the first blocking ends of the sliding slots 32A respectively, and when the foldable lens 41A is flipped in the second position, the sliding ends of the guiding arms 422A are blocked by the second blocking ends of the sliding slots 32A respectively. Accordingly, the first blocking ends of the sliding slots 32A are extended toward the front opening of the sight housing 21 while the second blocking ends of the sliding slots 32A are extended away from the front opening of the sight housing 21. In other words, each of the sliding slots 32A has a predetermined length to restrict the flipping displacement of the foldable lens 41A.

In order to ensure the sliding ends of the guiding arms 422A being slid at the sliding slots 32A in a synchronized manner, the flipping joint 42A further comprises a connection axle 423A connected between the sliding ends of the guiding arms 422A and slidably engaged at the sliding slots 32A. Therefore, when the foldable lens 41A is rotatably flipped between the first and second positions, the sliding ends of the guiding arms 422A will be slid at the sliding slots 32A in a synchronized manner.

FIGS. 8 and 9 illustrate the flipping movement of the foldable lens 41A. In the first position, the foldable lens 41A is retained at the front opening of the sight housing 21 to form the protection lens for protecting the objective lens 221. The foldable lens 41A is adapted to rotatably and upwardly flip at the rotatable axle 421A to move from the first position to the second position. When the sliding ends of the guiding arms 422A are blocked by the second blocking ends of the sliding slots 32A respectively, the foldable lens 41A is moved in the second position. Accordingly, when the reflex sight 30 is mounted on the top side of the sight housing 21, the foldable lens 41A is flipped to upwardly extend from the sight housing 21. Therefore, the foldable lens 41A forms the projection lens for the sight reticle being projected thereon in the second position. It is worth mentioning that the foldable lens 41A is flipped 180° about the rotatable axle 421A between the first and second positions. Furthermore, during the flipping movement of the foldable lens 41A, the sliding ends of the guiding arms 422A not only slide but also rotate at the sliding slots 32A respectively.

It is worth mentioning that when the foldable lens 41 is rotatably flipped at 90° from the first position, the sliding ends of the guiding arms 422A are blocked by the first blocking ends of the sliding slots 32A respectively. In other words, the sliding ends of the guiding arms 422A are reciprocatingly slid between the first and second blocking ends of the sliding slots 32A when the foldable lens 41A is flipped between the first and second positions.

It should be appreciated that if the reflex sight 30 is mounted at the side of the sight housing 21, the foldable lens 41A can be sidewardly flipped about the rotatable axle 421A to align with the reflex sight 30. In other words, the flipping direction of the foldable lens 41A is determined based upon the location of the reflex sight 30.

It should be also appreciated that a positioning sensor, such as a touch switch, can be incorporated with the foldable lens 41A to automatically switch on the reflex sight 30 when the foldable lens 41A is moved in the second position. For example, the touch switch can be installed at the front opening of the sight housing 21 to operatively link to the control switch of the reflex sight 30. Therefore, when the foldable lens 41A is flipped to cover at the front opening of the sight housing 21 and to activate the touch switch, the reflex sight 30 will be automatically switched off. When the foldable lens 41A is flipped out of the front opening of the sight housing 21 and to deactivate the touch switch, the reflex sight 30 will be automatically switched on. As a result, the operator requires one single action to move the foldable lens 41A from the first position to the second position and to switch on the reflex sight 30 at the same time.

Referring to FIGS. 10 to 13, the sight module of a third embodiment illustrates a second alternative mode of the first embodiment. According to the third embodiment, the sight module has the same configuration of the first embodiment, except the lens arrangement 40B.

Figure 12:
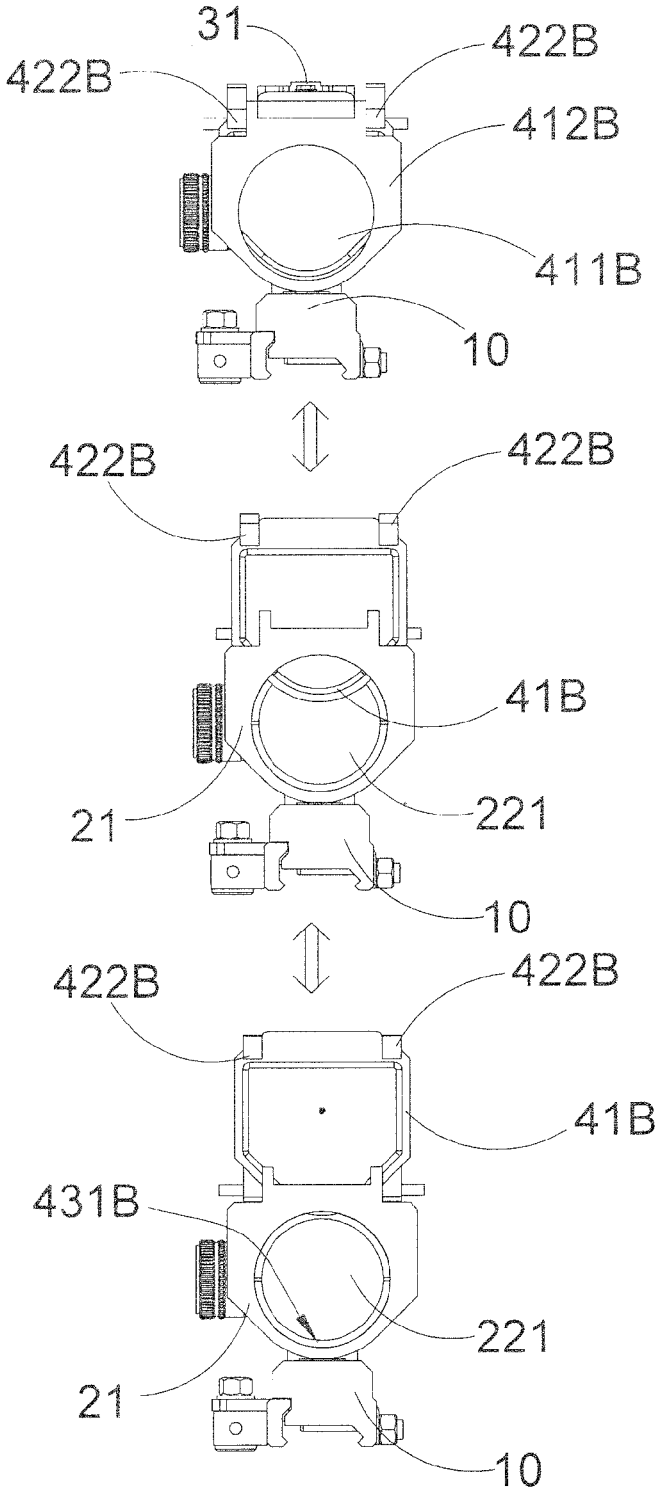
FIG. 12 is a front view of the sight module according to the above third preferred embodiment of the present invention, illustrating the sliding movement of the foldable lens between the first and second positions.
Figure 13:
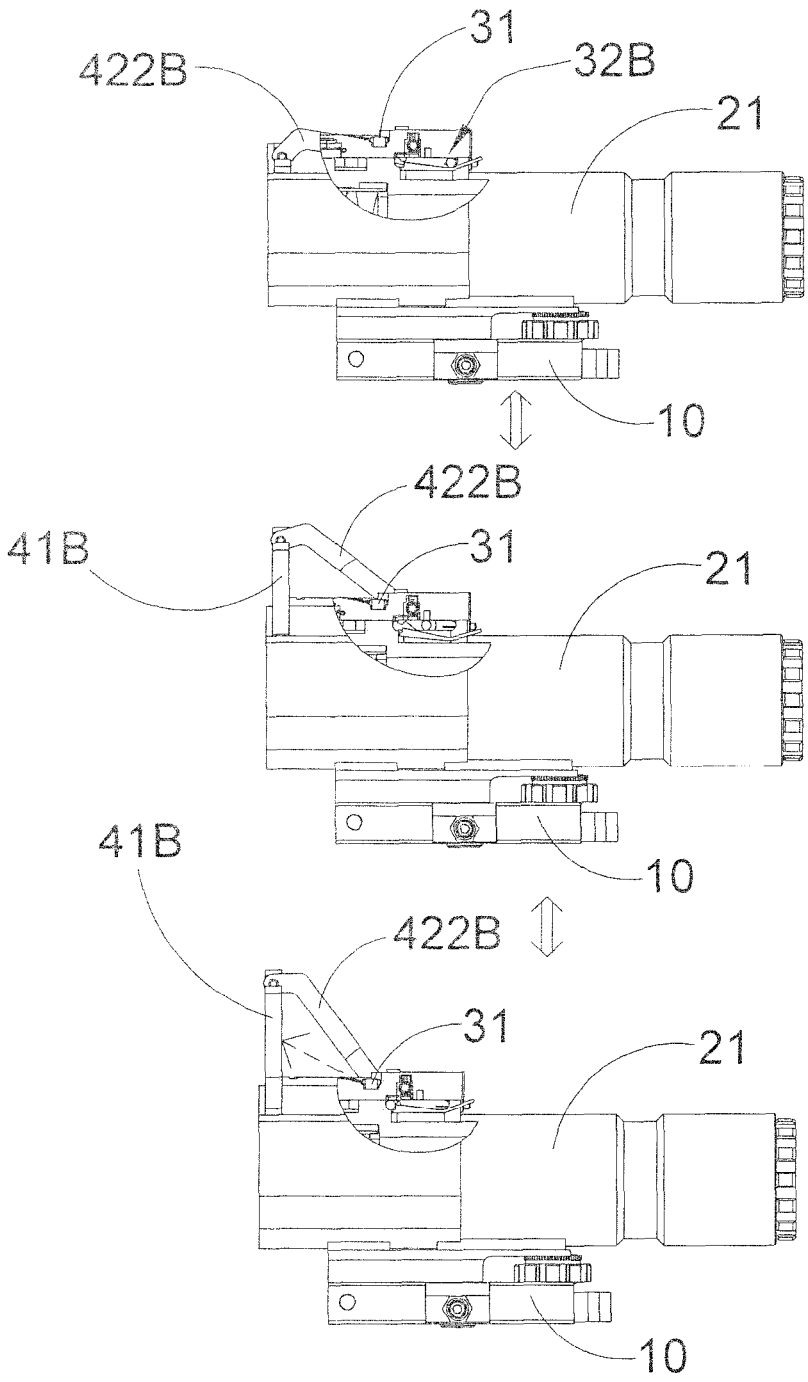
FIG. 13 is a side view of the sight module according to the above third preferred embodiment of the present invention, illustrating the sliding movement of the foldable lens between the first and second positions.
Figure 14:
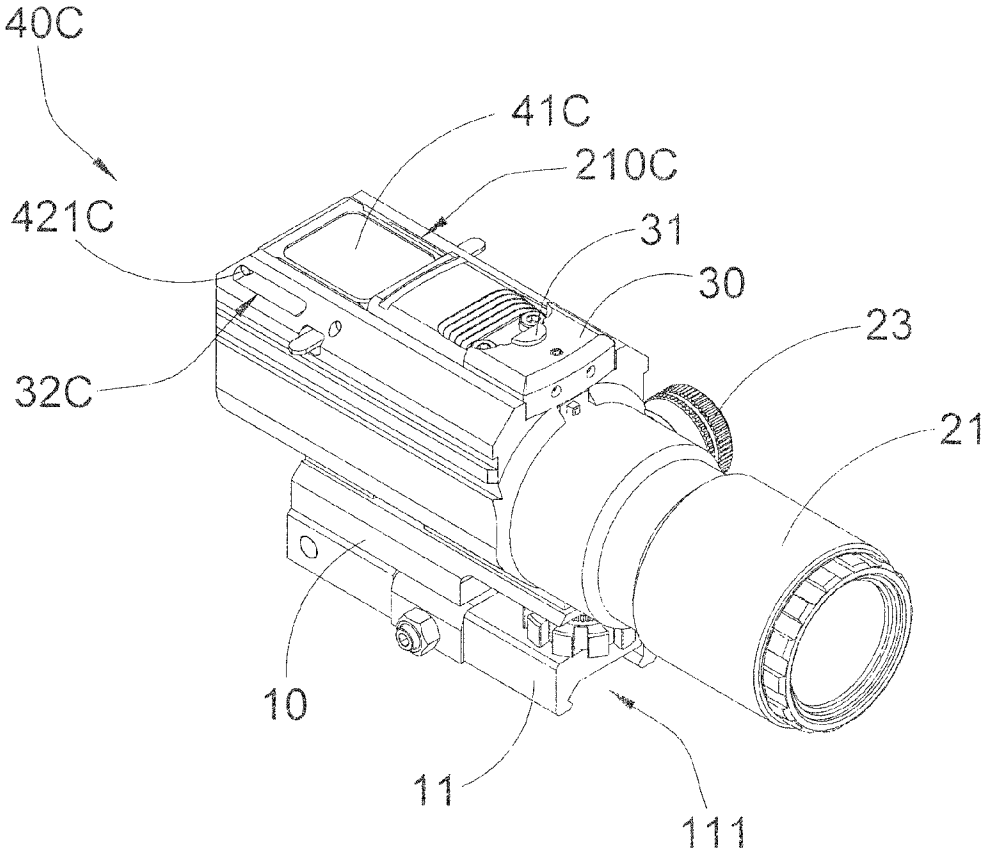
FIG. 14 is a perspective view of the sight module according to a fourth preferred embodiment of the present invention.
Figure 15:
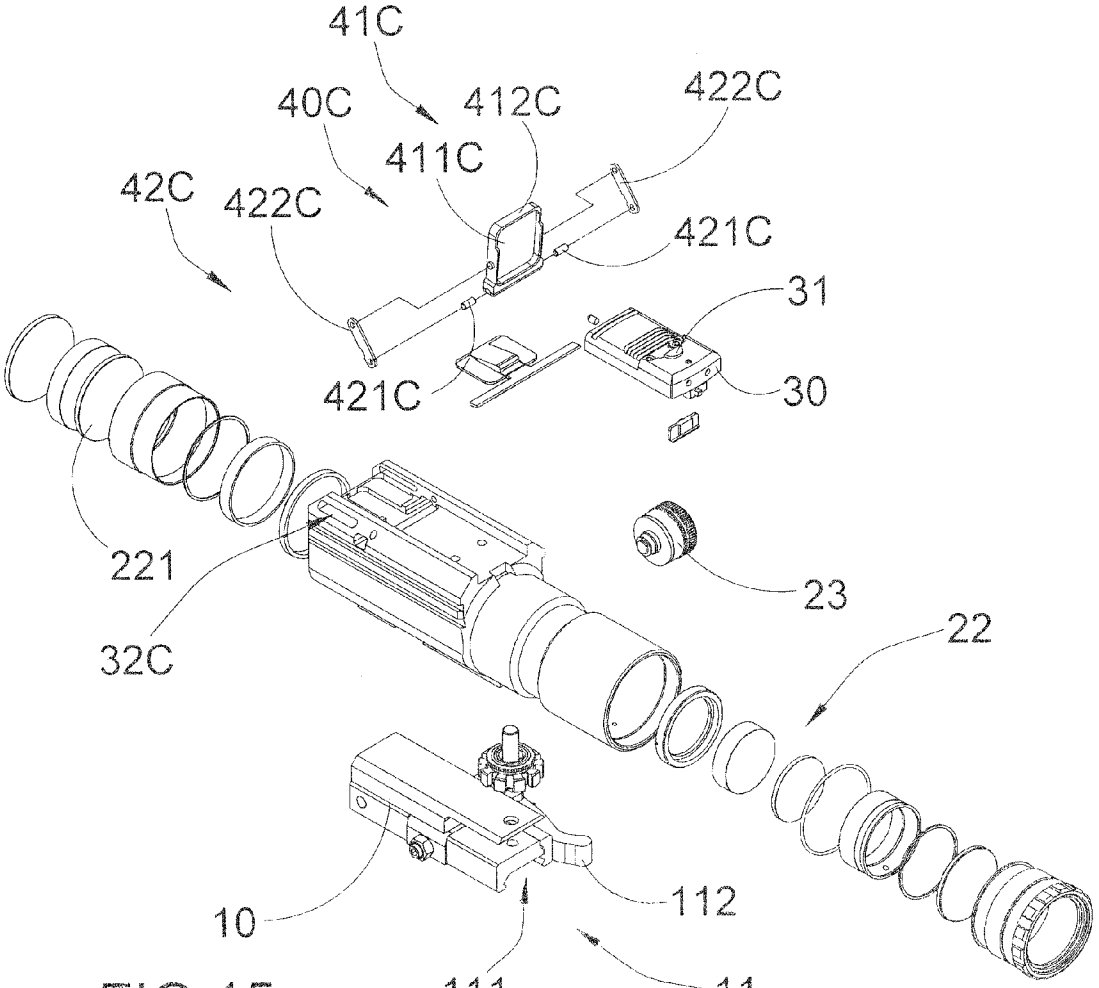
FIG. 15 is an exploded perspective view of the sight module according to the above fourth preferred embodiment of the present invention.

The lens arrangement 40B comprises a foldable lens 41B movably coupled at the sight housing 21 and being actuated to move between a first position and a second position, as shown in FIGS. 12 and 13. In the first position, the foldable lens 41B is folded at the sight housing 21. In the second position, the foldable lens 41B is moved to outwardly extend from the sight housing 21, such that the sight reticle generated by the reflex sight 30 is projected on the foldable lens 41B in the second position. The foldable lens 41B comprises a transparent lens body 411B and a lens rim 412B encircling around the lens body 411B.

The lens arrangement 40B further comprises a joint unit 42B coupled between a sidewall of the sight housing 21B and a peripheral edge of the foldable lens 41B to enable the foldable lens 41B to be moved at the front opening of the sight housing 21 in the first position and to be moved outwardly from the front opening of the sight housing 21 so as to enable the sight reticle to be projected on the foldable lens 41B in the second position.

In particular, the joint unit 42B, according to the third embodiment, is a sliding joint coupling the foldable lens 41B with the sight housing 21 to slide the foldable lens 41B between the first and second positions. Accordingly, the sliding joint 42B comprises two guiding arms 422B extended between the reflex sight 30 and the foldable lens 41B, wherein each of the guiding arms 422B has a sliding end slidably coupled at a sidewall of the reflex sight 30 and a pivot end pivotally coupled at the foldable lens 41B, such that when the foldable lens 41B is slid between the first and second positions, the guiding arms 422B are slid at the sidewalls of the reflex sight 30 to guide a sliding movement of the foldable lens 41B. In particular, the pivot ends of the guiding arms 422B are spacedly and pivotally coupled at two sides of the lens rim 412B at the top edge thereof respectively via a pivot axle 421B to guide the sliding movement of the foldable lens 41B. Therefore, the foldable lens 41B is guided to vertically and upwardly slide from the first position to the second position.

For ensuring the sliding movement of the foldable lens 41B, the reflex sight has two sliding slots 32B longitudinally formed at the two sidewalls to slidably engage with the sliding ends of the guiding arms 422B respectively, wherein each of the sliding slots 32B has a first blocking end and an opposed second blocking end arranged in such a manner that when the foldable lens 41B is slid in the first position, the sliding ends of the guiding arms 422B are blocked by the first blocking ends of the sliding slots 32B respectively, and when the foldable lens 41B is slid in the second position, the sliding ends of the guiding arms 422B are blocked by the second blocking ends of the sliding slots 32B respectively. Accordingly, the first blocking ends of the sliding slots 32B are extended away from the front opening of the sight housing 21 while the second blocking ends of the sliding slots 32B are extended toward the front opening of the sight housing 21. In other words, each of the sliding slots 32B has a predetermined length to restrict the sliding displacement of the foldable lens 41B.

In order to ensure the sliding ends of the guiding arms 422B being slid at the sliding slots 32B in a synchronized manner, the flipping joint 42B further comprises a connection axle 423B connected between the sliding ends of the guiding arms 422B and slidably engaged at the sliding slots 32B. Therefore, when the foldable lens 41B is vertically slid between the first and second positions, the sliding ends of the guiding arms 422B will be slid at the sliding slots 32B in a synchronized manner.

Accordingly, the lens arrangement 40B further has a guiding slot 43B integrally formed at the sidewall of the sight housing 21 at the front opening thereof, wherein the foldable lens 41B is guided to slide at the guiding slot 43B to the first position and is guided to slide out of the guiding slot 43B to the second position. Accordingly, the guiding slot 43 is circumferentially formed at the sidewall of the sight housing 21 at the front portion thereof, wherein a width of the guiding slot 43B is slightly larger than a thickness of the foldable lens 41B, such that the foldable lens 41B can be slid into the guiding slot 43B to coaxially support at the front opening of the sight housing 21.

Furthermore, the guiding slot 43B has an arc configuration matching with a curvature of the sight housing 21, wherein the guiding slot 43B has a blocking surface 431B defined at the bottom side of the sight housing to bias against the peripheral edge of the foldable lens 41B when the foldable lens 41B is moved in the first position. In particular, the foldable lens 41B is pressed downwardly into the guiding slot 43 until the foldable lens 41B is blocked by the blocking surface 431B to block the further downward sliding movement of the foldable lens 41B when the foldable lens 41B is slid in the first position.

FIGS. 12 and 13 illustrate the sliding movement of the foldable lens 41B. In the first position, the foldable lens 41B is retained at the front opening of the sight housing 21 to form the protection lens for protecting the objective lens 221. The foldable lens 41B is adapted to upwardly slide to move from the first position to the second position. When the sliding ends of the guiding arms 422B are blocked by the second blocking ends of the sliding slots 32B respectively, the foldable lens 41B is moved in the second position. Accordingly, when the reflex sight 30 is mounted on the top side of the sight housing 21, the foldable lens 41B is slid to upwardly extend from the sight housing 21. Therefore, the foldable lens 41B forms the projection lens for the sight reticle being projected thereon in the second position. It should be appreciated that if the reflex sight 30 is mounted at the side of the sight housing 21, the foldable lens 41B can be sidewardly slid to align with the reflex sight 30. In other words, the sliding direction of the foldable lens 41B is determined based upon the location of the reflex sight 30.

It should be also appreciated that a positioning sensor, such as a touch switch, can be incorporated with the foldable lens 41B to automatically switch on the reflex sight 30 when the foldable lens 41B is moved in the second position. For example, the touch switch can be installed at the guiding slot 43B to operatively link to the control switch of the reflex sight 30. Therefore, when the foldable lens 41B is moved at the guiding slot 43B to activate the touch switch, the reflex sight 30 will be automatically switched off. When the foldable lens 41B is moved out of the guiding slot 43 to deactivate the touch switch, the reflex sight 30 will be automatically switched on. As a result, the operator requires one single action to move the foldable lens 41B from the first position to the second position and to switch on the reflex sight 30 at the same time.

Referring to FIGS. 14 to 17, the sight module of a fourth embodiment illustrates a third alternative mode of the first embodiment. According to the third embodiment, the sight module has the same configuration of the first embodiment, except the lens arrangement 40C.

Figure 16:
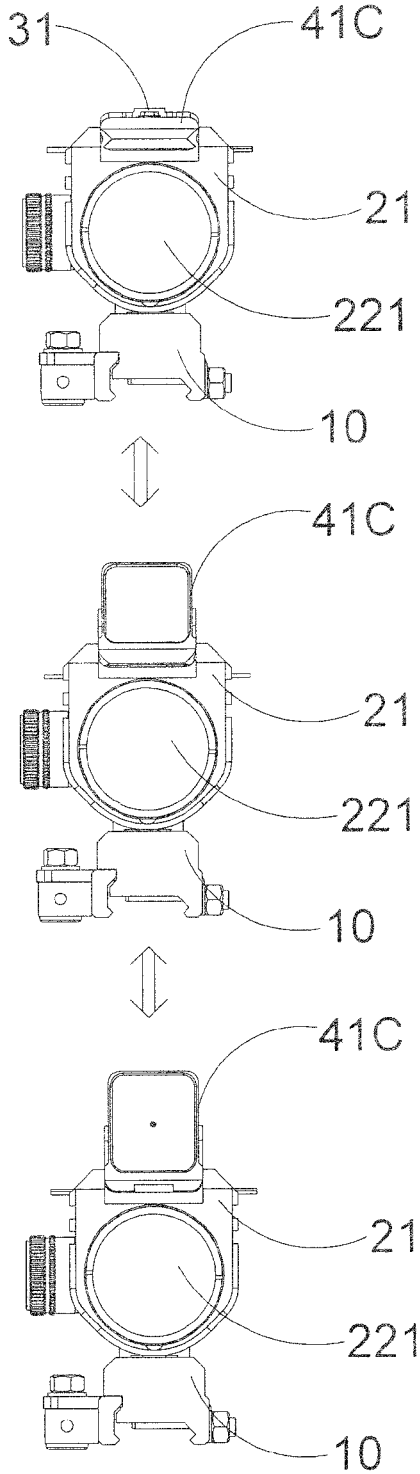
FIG. 16 is a front view of the sight module according to the above fourth preferred embodiment of the present invention, illustrating the sliding movement of the foldable lens between the first and second positions.
Figure 17:
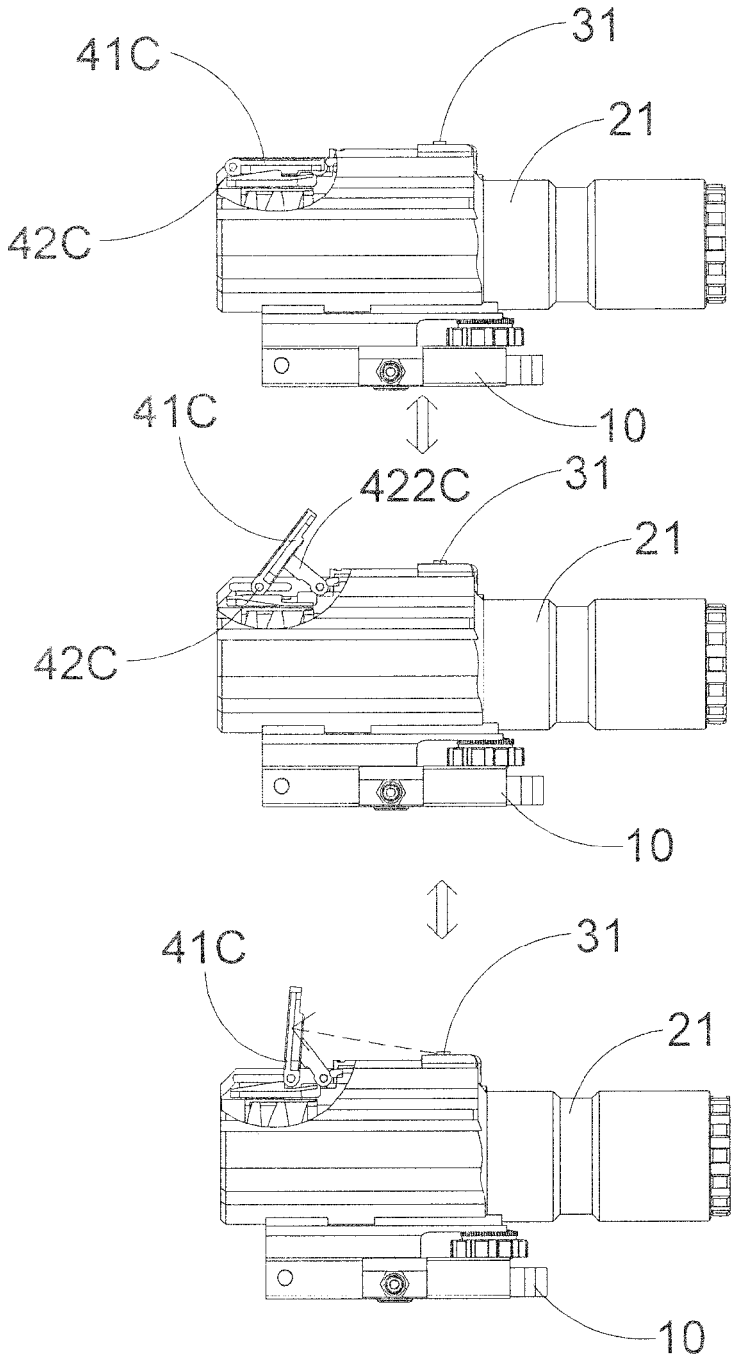
FIG. 17 is a side view of the sight module according to the above fourth preferred embodiment of the present invention, illustrating the sliding movement of the foldable lens between the first and second positions.

The lens arrangement 40C comprises a foldable lens 41C movably coupled at the sight housing 21 and being actuated to move between a first position and a second position, as shown in FIGS. 16 and 17. In the first position, the foldable lens 41C is folded at the sight housing 21. In the second position, the foldable lens 41C is moved to outwardly extend from the sight housing 21, such that the sight reticle generated by the reflex sight 30 is projected on the foldable lens 41C in the second position. The foldable lens 41C comprises a transparent lens body 411C and a lens rim 412C encircling around the lens body 411C.

The lens arrangement 40C further comprises a joint unit 42C coupled between a sidewall of the sight housing 21 and a peripheral edge of the foldable lens 41C to enable the foldable lens 41C to be moved between the first and second positions.

In particular, the joint unit 42C, according to the fourth embodiment, is a sliding joint comprising two sliding members 421C outwardly and oppositely extended from the foldable lens 41C to slidably engage with the sight housing 21, wherein the foldable lens 41C is horizontally overlapped on the sight housing 21 in the first position to provide a low-profile configuration and is slid to perpendicular to the sight housing 21 in the second position so as to enable the sight reticle to be projected on the foldable lens 41C in the second position. Preferably, the sliding members 421C are sidewardly extended from two sides of the lens rim 412C at the bottom portion thereof.

For ensuring the sliding movement of the foldable lens 41B, wherein the reflex sight has two sliding slots 32C longitudinally formed at the two sidewalls to slidably engage with the foldable lens 41C, wherein each of the sliding slots 32C has a first blocking end and an opposed second blocking end arranged in such a manner that when the foldable lens 41C is slid in the first position, the sliding members 421C are blocked by the first blocking ends of the sliding slots 32C respectively, and when the foldable lens 41C is slid in the second position, the sliding members 421C are blocked by the second blocking ends of the sliding slots 32C respectively. Accordingly, the first blocking ends of the sliding slots 32C are extended toward the front opening of the sight housing 21 while the second blocking ends of the sliding slots 32B are extended away from the front opening of the sight housing 21. In other words, each of the sliding slots 32C has a predetermined length to restrict the sliding displacement of the foldable lens 41C.

According to the fourth embodiment, the sliding joint 42C comprises two guiding arms 422C extended between the reflex sight 30 and the foldable lens 41C, wherein each of the guiding arms 422C has a first pivot end slidably coupled at a sidewall of the reflex sight 30 and a second pivot end pivotally coupled at the foldable lens 41C, such that when the foldable lens 41C is slid between the first and second positions, the guiding arms 422C guide a sliding movement of the foldable lens 41C. Accordingly, the second pivot ends of the guiding arms 422C are pivotally coupled at two sides of the lens rim 412C at the mid-portion thereof.

Preferably, the sight housing 21 further has a receiving cavity 210C indentedly formed on the top side of the sight housing 21, wherein the foldable lens 41C is slid into the receiving cavity 210C in the first position. In other words, the foldable lens 41C is horizontally overlapped on the sight housing 21 and received in the receiving cavity 210C when the foldable lens 41C is moved in the first position.

FIGS. 16 and 17 illustrate the sliding movement of the foldable lens 41C. In the first position, the foldable lens 41C is horizontally overlapped on the sight housing 21 and received in the receiving cavity 210C to provide a low profile configuration of the lens arrangement 40C. The foldable lens 41C is adapted to upwardly slide to move from the first position to the second position. When the sliding members 421C are blocked by the second blocking ends of the sliding slots 32C respectively, the foldable lens 41C is moved in the second position. Accordingly, when the reflex sight 30 is mounted on the top side of the sight housing 21, the foldable lens 41C is vertically and upwardly slid to upwardly extend from the sight housing 21. Therefore, the foldable lens 41C forms the projection lens for the sight reticle being projected thereon in the second position. It should be appreciated that if the reflex sight 30 is mounted at the side of the sight housing 21, the foldable lens 41C can be sidewardly slid to align with the reflex sight 30. In other words, the sliding direction of the foldable lens 41C is determined based upon the location of the reflex sight 30.

It should be also appreciated that a positioning sensor, such as a touch switch, can be incorporated with the foldable lens 41C to automatically switch on the reflex sight 30 when the foldable lens 41C is moved in the second position. For example, the touch switch can be installed on the top side of the sight housing 21 to operatively link to the control switch of the reflex sight 30. Therefore, when the foldable lens 41C is moved on the top side of the sight housing 21 to activate the touch switch, the reflex sight 30 will be automatically switched off. When the foldable lens 41B is moved away from the top side of the sight housing 21 to deactivate the touch switch, the reflex sight 30 will be automatically switched on. As a result, the operator requires one single action to move the foldable lens 41C from the first position to the second position and to switch on the reflex sight 30 at the same time.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A sight module configured for a firearm, comprising:

a mounting base configured for detachably mounting on said firearm;

a sight unit which comprises a sight housing upwardly extended from said mounting base to define a sight axis parallel to a barrel axis of said firearm;

a reflex sight which comprises a light unit supported by said sight housing configured for generating a sight reticle; and a lens arrangement which comprises a foldable lens configured to be movably coupled at said sight housing and being actuated to move between a first position and a second position, wherein in said first position, said foldable lens is folded at said sight housing, and in said second position, said foldable lens is moved to outwardly extend from said sight housing, such that said sight reticle generated by said reflex sight is projected on said foldable lens in said second position.

2. The sight module, as recited in claim 1, wherein said lens arrangement further comprises a joint unit coupled between a sidewall of said sight housing and a peripheral edge of said foldable lens to enable said foldable lens to be moved on said sight housing in said first position and to be moved outwardly from said sight housing so as to enable said sight reticle to be projected on said foldable lens in said second position.

3. The sight module, as recited in claim 1, wherein said sight unit further has an attachment platform formed on a top side of said sight housing to detachably couple with said reflex sight, such that said foldable lens is moved upwardly from said sight housing in said second position in order to enable said sight reticle to be projected on said foldable lens.

4. The sight module, as recited in claim 2, wherein said sight unit further has an attachment platform formed on a top side of said sight housing to detachably couple with said reflex sight, such that said foldable lens is moved upwardly from said sight housing in said second position in order to enable said sight reticle to be projected on said foldable lens.

5. The sight module, as recited in claim 1, wherein said foldable lens is movably coupled on said sight housing, such that said foldable lens is horizontally overlapped on said sight housing at said first position and is folded to perpendicular to said sight housing at said second position.

6. The sight module, as recited in claim 2, wherein said foldable lens is movably coupled on said sight housing, such that said foldable lens is horizontally overlapped on said sight housing at said first position and is folded to perpendicular to said sight housing at said second position.

7. The sight module, as recited in claim 4, wherein said foldable lens is movably coupled on said sight housing, such that said foldable lens is horizontally overlapped on said sight housing at said first position and is folded to perpendicular to said sight housing at said second position.

8. The sight module, as recited in claim 2, wherein said joint unit comprises two guiding arms pivotally coupled at said foldable lens to pivotally move said foldable lens between said first position and said second position.

9. The sight module, as recited in claim 4, wherein said joint unit comprises two guiding arms pivotally coupled at said foldable lens to pivotally move said foldable lens between said first position and said second position.

10. The sight module, as recited in claim 7, wherein said joint unit comprises two guiding arms pivotally coupled at said foldable lens to pivotally move said foldable lens between said first position and said second position.

11. The sight module, as recited in claim 1, wherein said sight housing further has a receiving cavity formed on a top side of said sight housing at a position that said foldable lens is received at said receiving cavity at said first position.

12. The sight module, as recited in claim 2, wherein said sight housing further has a receiving cavity formed on a top side of said sight housing at a position that said foldable lens is received at said receiving cavity at said first position.

13. The sight module, as recited in claim 10, wherein said sight housing further has a receiving cavity formed on a top side of said sight housing at a position that said foldable lens is received at said receiving cavity at said first position.

14. The sight module, as recited in claim 1, wherein said foldable lens comprises a transparent lens body and a lens rim encircling around said lens body.

15. The sight module, as recited in claim 2, wherein said foldable lens comprises a transparent lens body and a lens rim encircling around said lens body.

16. The sight module, as recited in claim 10, wherein said foldable lens comprises a transparent lens body and a lens rim encircling around said lens body.

* * * * *